United States Patent [19]

Kawamura et al.

[11] Patent Number: 4,566,518

[45] Date of Patent: Jan. 28, 1986

[54] METHOD OF HEAT RETENTION IN A BLIND RISER

[75] Inventors: Jun Kawamura, Nikko; Sakuzo Fukano, Tokyo, both of Japan

[73] Assignee: Aikoh Co., Ltd., Tokyo, Japan

[21] Appl. No.: 531,048

[22] Filed: Sep. 12, 1983

[51] Int. Cl.[4] ..... B22D 27/04

[52] U.S. Cl. ..... 164/53; 164/360

[58] Field of Search ..... 164/53, 360

[56] References Cited

U.S. PATENT DOCUMENTS

| | | | |
|---|---|---|---|
| 1,239,586 | 9/1917 | Gebhard | 164/53 |
| 2,334,701 | 11/1943 | Galvin et al. | 164/53 X |
| 2,335,008 | 11/1943 | Hites | 164/53 X |
| 2,568,428 | 9/1951 | Billiar | 164/53 X |
| 2,791,815 | 5/1957 | Kinnear | 164/53 |

FOREIGN PATENT DOCUMENTS

| | | | |
|---|---|---|---|
| 595795 | 12/1947 | United Kingdom | 164/53 |
| 290782 | 2/1971 | U.S.S.R. | 164/53 |

OTHER PUBLICATIONS

Chistyakov, V. F. et al., "Use of Exothermic Briquets in Steel Teeming", in *Metallurgist,* vol. 18, No. 3–4, Mar.-/Apr. 1974, pp. 188–190.

*Primary Examiner*—Nicholas P. Godici
*Assistant Examiner*—J. Reed Batten, Jr.
*Attorney, Agent, or Firm*—Pearne, Gordon, Sessions, McCoy, Granger & Tilberry

[57] ABSTRACT

A method of the heat-retention in a blind riser in metal casting by using a sand mould, characterized in that an exothermic moulded composition is arranged in a drag holding cavity below a blind riser in the cope of the mould or in the neighborhood of the blind riser before the melt is poured, and thereafter the melt is poured to cause the exothermic moulded composition to float up into the blind riser to retain heat therein.

4 Claims, 2 Drawing Figures

METHOD OF HEAT RETENTION IN A BLIND RISER

BACKGROUND OF THE INVENTION

This invention relates to a method of heat-retention in a blind riser and a heat-retaining agent for the blind riser, intending to promote the feeding effect of melt from the blind riser in manufacturing metal castings by using a sand mould.

Generally, in manufacturing castings, to obtain casting products sound in inner quality by preventing the generation of a shrinkage cavity, caused by the solidification shrinkage of molten metal cast into the mould there is provided a riser at or near a thick portion of the product.

Also it is known that in moulds for metal casting there are selectively used, in association with the shape of the casting product and the flask or in relation to the reduction of melt, an open riser in which the upper surface of the riser is open to atmosphere and a blind riser is used in which the upper surface of the riser is closed within the flask.

In the case of a blind riser is used the following means are taken for the purpose of sufficiently exhibiting the effect of the riser thereby to smoothly feed, from the blind riser, the melt equivalent amount of solidification shrinkage amount of the casting:

(1) The blind riser is designed to retain heat in order that the blind riser may not be solidified quicker than the casting.

(2) Atmospheric pressure is introduced within the blind riser to accelerate the transfer of melt from the blind riser to the casting.

As means (1) above, there is employed a method of enclosing the blind riser with a moulded sleeve having an exothermic or heat insulating property, or both, and as means (2) above there is employed an "atmospheric riser" in which a good air-permeating, heat insulating or exothermic core is inserted near the top center of the blind riser. It is also known to use a blind riser sleeve using both the two means (1) and (2) above.

However, these known techniques have the following demerits. That is, in the method of using a moulded sleeve there are mentioned, as demerits, difficulty in mounting the sleeve in the sand mould or pattern, deformation or breakage of the sleeve in the moulding process, and/or release of the sleeve from the sand mould; while with regard to the atmospheric riser the problems are the difficulty of inserting a core into said portion and the sand release caused by the friction at the time of insertion. Further, such demerits either delay the cycle time of moulding or bring about defects in the inner quality of the casting.

SUMMARY OF THE INVENTION

The present invention has solved the problems of the known techniques and it is the object of the invention to provide a method of heat retention in a blind riser, in which the performance of the blind riser is simply and effectively promoted, and a heat-retaining agent of the blind riser for use in said method. That is, the invention relates to a method for retaining heat in a blind riser, characterized in that in sand mould casting an exothermic composition of a spherical body, rotary ellipsoid or polyhedron of more than a hexahedron, or in the form of a briquette, is placed at least one per blind riser in the cavity portion of the mould before pouring the melt, and said composition floats up as the melt flows in so as to be positioned at the top of the blind riser when the pouring of the melt has finished thereby retaining heat at the top of the blind riser. The invention further relates to a heat-retaining agent for a blind riser in the moulding by use of a sand mould, characterized in that the exothermic composition is a sphere, rotary ellipsoid or polyhedron of more than a hexahedron, or in the form of a briquette, and the bulk specific gravity is less than the specific gravity of the melt.

As to the exothermic composition herein used, those conventionally presented for the heat retention in risers of casting moulds can be used as they are, and as to the blending ingredients for rate controlling of the heating value, it will suffice to select them within the range in which the bulk specific gravity is less than the specific gravity of the melt according to the capacity of the respective blind riser and the desired exothermic reaction sustaining period of time. The reason why the composition is a sphere, rotary ellipsoid or polyhedron of more than a hexahedron, or in the form of a briquette, is to consider the buffeting effect on the sand mould wall when the exothermic moulded composition floats up after pouring, and the sustaining effect of the exothermic reaction by the ignition after having contacted the melt. Then, even as to the moulding method in which the exothermic composition is formed as described above it is possible to carry out by a method where the composition is moulded with the addition of known binders or by conventional techniques such as briquette moulding process by a pan pelletizing machine.

DESCRIPTION OF THE PREFERRED EMBODIMENT

Figure 1:
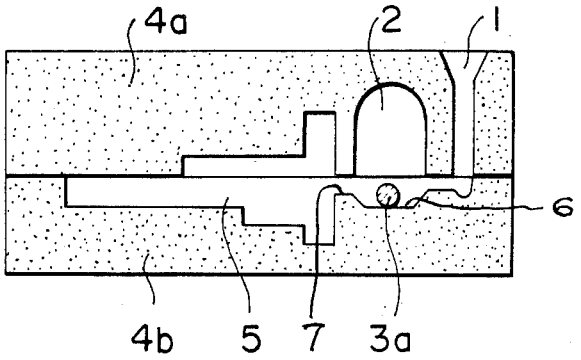
FIGS. 1 and 2 are vertical sectional views showing one example of the method for the heat retention in a blind riser of the invention.

In metal casting in a sand mould an exothermic heat-retaining agent (3*a*) of the invention is located at a holding cavity (6) of a blind riser (2) within the mould before a cope (4*a*) and a drag (4*b*) are assembled. Additionally, depending on the configuration of the mould it is possible to locate said heat-retaining agent (3*a*) at the cavity (6) of the blind riser even after assembling the mould. In the drawings reference numeral (1) designates a sprue and reference (5) a main mould cavity of the mould.

The thus obtained heat-retaining agent for the blind riser of the invention can be used being simply placed at the cavity (6) of the blind riser (2) of said sand mould. This method can be easily carried out at the optional period of time before the cope and drag (4*a*, 4*b*) are assembled in the moulding process of the mould, and according to the casting plan to be applied, for example in case there exists an opening to the outside of the mould, which opening is communicated with a position expected for placing the heat-retaining agent, it is possible to place it even after assembling the mould. It is possible to select the placing position of the heat-retaining agent (3*a*) at any place such that said agent (3*a*) will be positioned (3*b*) at the top of the blind riser when the pouring of the melt has finished, after said agent has floated up by the flow of the melt; namely, placing it in the neighborhood of the blind riser. Being the shortest distance to the top of the blind riser, however, it is preferable to constitute the bottom of the blind riser with a holding cavity. A single briquette of the heat-retaining agent will suffice for use per blind riser, but a plurality of briquettes of said agent can be used, if necessary, to keep in balance with the volume of the blind riser.

Additionally, to prevent the exothermic moulded composition (3*a*) arranged within the blind riser from transferring into the mould cavity (5), the gate (7) between the blind riser (2) and the mould cavity (5) is made naturally smaller than the dimension of said composition.

Figure 2:
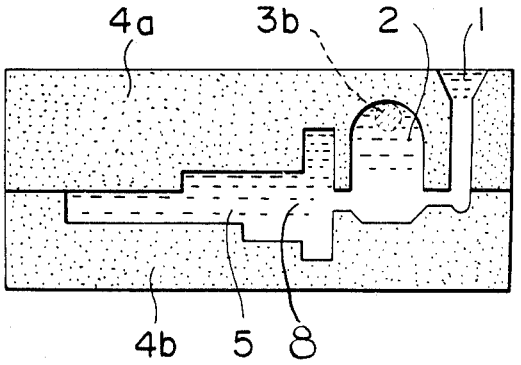

Then when the melt is poured into the mould, as shown in FIG. 2, said heat-retaining agent easily floats up with the flow of the melt and is ignited from its contact with the melt while generating heat, and finally it reaches the top of the blind riser thereby to stop there (3*b*). In the floating-up process said heat-retaining agent as well as the inner wall of the mould is not impaired thanks to its shape when contacting the wall portion of the sand mould, and therefore no casting defect regarding the casting surface or the quality of the casting is brought about.

Since the heat generation of said heat-retaining agent is started at the same time as its contact with the melt as described above, the melt surface enclosing said agent reaches the top of the blind riser while being heat retained, together with said agent. The generated heat is maintained for a predetermined period of time according to the selection of constitution, shape, and dimension of said heat-retaining agent, so that the blind riser is solidified slowly whereby the feeding effect to the casting is increased. Further, thanks to the air permeability possessed by said heat-retaining agent the atmospheric pressure is introduced into the blind riser without any impairment, allowing the feeding effect to be increased.

In the blind riser after solidification in the casting article in which the present invention has been carried out, a shrinkage cavity remains in the area from the top portion of the solidified metal to the cope portion of the blind riser cavity as a result of the heat-retaining effect by said heat-retaining agent and the sufficient feed of melt to the casting. In said shrinkage cavity in the top portion there remains the heat-retaining agent of the invention, in its original shape, said agent having been sintered after the completion of the heat generation. Accordingly, there does not occur such phenomenon that the heat-retaining agent after use is mixed as residue with the recovered sand after the dismantling of the mould and the separation of the heat-retaining agent from the casting is easy, generally at the gate (7).

The invention will now be described more in detail by way of example.

Exothermic moulded compositions were prepared in a metal mould from an exothermic composition consisting of 25% by weight of metallic aluminum, 5% by weight of ferrous oxide, 20% by weight of ferric oxide, 5% by weight of barium nitrate, 3% by weight of sodium fluoride, 27% by weight of swollen obsidian, 5% by weight of siliceous sand, and 10% by weight of phenolformaldehyde resin, then the mouldings were thermally hardened to make spheres. One sphere thereof was placed at the bottom of each of the blind risers provided in the sand moulds for ductile cast iron and cast steel, the moulds were assembled, and finally the respective melts were cast, with the following result:

| | Example 1 | Example 2 |
|---|---|---|
| Cast material | Ductile cast iron | Cast steel |
| Dimension (mm) of heat-retaining agent | 30Ø | 45Ø |
| Bulk specific gravity of same | 0.9 | 0.9 |
| Dimension (mm) of blind riser | 55Ø × 90 | 100Ø × 150 |
| Casting temperature (°C.) | 1390 | 1520 |
| Product | No defect in inner quality | No defect in inner quality |

Thereafter the inner quality of the products was inspected with regard to samples cut in 10 mm thickness in the direction of the center line, and no defect was noticed for each of the samples. At that time, the same test was carried out in a blind riser not provided with a heat-retaining agent of the invention but by means of sand mould only, but shrinkage cavities were found in the center of the thick portion 8 of the cast metal and in the neighborhood of the gate (7).

What is claimed is:

1. The method of heat retention in a blind riser in a metal casting method by using a cope and drag sand mould having a blind riser and a mould cavity, comprising the steps of:

loosely placing a briquette-like exothermic moulded composition in the drag below the blind riser in the cope;

said exothermic moulded composition having a bulk specific gravity less than that of the molten metal of the casting method; creating a holding cavity in the drag below the blind riser in the cope;

said exothermic moulded composition being of a size larger than a gate between the holding cavity and the mould cavity to preclude escape of the exothermic moulded composition from the blind riser; and thereafter introducing molten metal into the mould cavity to contact the exothermic moulded composition and cause it to float up into the blind riser to generate an exothermic reaction, thereby increasing the heat retention of the melt in the blind riser and the feeding effect of the melt into the mould cavity.

2. The method of heat retention in a blind riser in sand mould casting as described in claim 1 wherein said briquette-like moulded composition is a sphere, rotary ellipsoid, or polyhedron of more than a hexahedron.

3. The method of heat retention in a blind riser as set forth in claim 1, wherein the exothermic moulded composition is placed in the drag and thereafter the cope is assembled on the drag.

4. The method of heat retention in a blind riser as set forth in claim 1, wherein the cope and the drag are first assembled, and then said exothermic moulded composition is charged into the bottom of the blind riser.

* * * * *